United States Patent [19]

Broadwater

[11] 4,338,697

[45] Jul. 13, 1982

[54] SIMPLIFIED POOL CLEANING APPARATUS

[76] Inventor: Caleb Broadwater, 21005 Reynolds Dr., #10, Torrance, Calif. 90503

[21] Appl. No.: 178,098

[22] Filed: Aug. 14, 1980

[51] Int. Cl.[3] ..... E04H 3/20

[52] U.S. Cl. ..... 15/1.7

[58] Field of Search ..... 15/1.7

[56] References Cited

FOREIGN PATENT DOCUMENTS 578354 6/1946 United Kingdom ..... 15/1.7

599030 3/1948 United Kingdom ..... 15/1.7

*Primary Examiner*—Edward L. Roberts

*Attorney, Agent, or Firm*—Poms, Smith, Lande & Rose

[57] ABSTRACT

A self-contained pool cleaning apparatus has a filter body with dirt and debris collectors positioned on the filter body front and back. During forward movement of the pool cleaning apparatus, the front debris collector is lowered to contact the pool surface by rearward movement of a wheel assembly mounted on the filter body bottom and forward pressure exerted on the filter body by way of handle mounted on the filter body. At the same time, the rearwardly oriented debris collector is raised away from the pool surface. During backward movement of the pool cleaning apparatus, the wheel assembly moves forward relative to the center of the filter body, resulting in the back debris collector being lowered into operating position engaging pool surface while the front debris collector is lifted away from the pool surface.

During both forward and backward movement, the debris collectors collect dirt and debris carried by the pool water and pass them through a filtering zone with the dirt and debris being filtered from the pool water, and with the pool water exiting through the top of the filter body. A foraminous partitioned insert and a cloth type filter element are provided within the filter zone for removing the dirt and debris.

12 Claims, 5 Drawing Figures

SIMPLIFIED POOL CLEANING APPARATUS

BACKGROUND OF THE INVENTION

The present invention relates generally to devices for cleaning underwater swimming pool surfaces. More specifically, the present invention relates to self contained pool cleaning devices which are manually powered and do not require vacuum or electrical hook-ups for operation.

With the increasing affluence of modern society, more and more individuals have and are continuing to install swimming pools near and many times even in their homes. Along with the increasing number of residential swimming pools, as well as public swimming pools, there has arisen the need for providing a convenient and simple device for cleaning dirt and other debris from the underwater pool surfaces. Many types of vacuum powered pool cleaning devices have been devised. These vacuum type pool cleaning devices are well suited for their intended purpose; however, the time consuming connection of hoses to appropriate pool filter pump motors for providing vacuuming action is many times awkward and inconvenient. Alternatively powered pool cleaning devices, such as electrically powered pool cleaning devices have not been popular due to risks involved utilizing electricity near water.

In attempts to provide adequate pool cleaning devices which are not based on filter pump driven vacuums, a number of prior art devices have been developed. Exemplary of such prior art devices are those shown in U.S. Pat. No. 4,176,419 issued to MacDonald, U.S. Pat. No. 4,152,801 issued to Lieber and U.S. Pat. No. 4,003,100 issued to Whitaker. All of these prior art pool cleaning devices are characterized by a butterfly net type construction having various opening configurations utilized for capturing dirt and debris along the underwater pool surfaces. These devices all require a sweeping motion which can be fatiguing and awkward, especially during cleaning of underwater surfaces at the deep end of swimming pools, which may be up to eight feet deep and more.

It is therefore desirable to provide a simplified and self contained swimming pool cleaning apparatus or device which may be easily moved about the underwater pool surfaces with a minimum amount of effort while still providing good cleaning action.

SUMMARY OF THE INVENTION

It is therefore an object of the present invention to provide a simplified pool cleaning apparatus which may be moved easily back and forth about the underwater pool surfaces.

Another object of the present invention is to provide a pool cleaning apparatus having an improved filtering system for removing dirt and debris from the pool water as it is passed through the apparatus.

A further object of the present invention is to provide a pool cleaning apparatus which is operative not only when moved in a forward direction but equally as well when moved in a reverse direction.

A final object of the present invention is to disclose and provide a pool cleaning apparatus which automatically positions the cleaning elements of the apparatus both when the apparatus is moved in a forward direction and when the apparatus is moved in a reverse direction.

The above objects and others are accomplished in accordance with the present invention by the provision of a pool cleaning apparatus adapted for cleaning underwater pool surfaces which includes a filter body having a bottom, an open top, two sides, a front and a back. The filter body further includes a first debris collector associated with an opening in the front of the filter body for collecting and introducing pool water and debris into the filter body during forward movement of the filter body. Further, a second debris collector is associated with an opening in the back of the filter body for collecting and introducing pool water and debris into the filter body during backward movement of the filter body.

In accordance with additional aspects of the invention, the two debris collectors provide for collection and passage of pool water and debris into the filter zone within the filter body during both forward and backward movement of the filter body. The debris collectors include lower resilient lips for contacting and removing debris from the pool surfaces and an upper lip for helping to guide water into the respective openings in the front or back of the filter body.

Another feature of the invention involves the provision of wheel means for moving the cleaning apparatus about the underwater pool surfaces. The wheel means are further designed to selectively position one of the two debris collectors on the underwater pool surface during cleaning.

Filter means are also provided in the present invention wherein two-stage filtering is accomplished. The two-stage filtering of the present invention provides for enhanced dirt/debris collection and removal. Further, arrangements are provided for easily removing the filter means for cleaning and replacement when necessary. The pool cleaning apparatus also includes an elongated handle mounted on the filter body for providing manual forward and backward movement of the filter body.

These and many other features and attendant advantages of the present invention will become apparent as the invention becomes better understood by reference to the following detailed description when considered in conjunction with the accompanying drawings.

DETAILED DESCRIPTION OF THE PREFERRED EXEMPLARY EMBODIMENT

Figure 1:
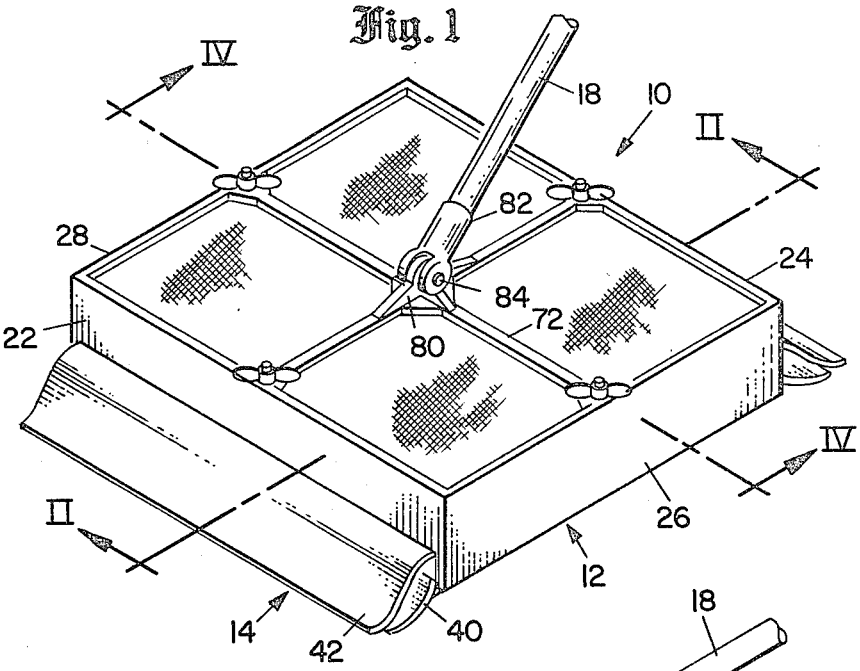
FIG. 1 is a plan view of a preferred pool cleaning apparatus in accordance with the present invention.

The preferred pool cleaning apparatus of the present invention is shown generally at 10 in FIG. 1. The pool cleaning apparatus 10 includes a filter body shown generally at 12, first and second debris collectors shown generally at 14 and 16 respectively, a handle 18 and the wheel assembly shown generally at 20 in FIG. 2.

The filter body 12 includes a front 22, a back 24, two sides 26 and 28, a bottom 30 and an open top 32. The filter body front 22 includes an opening 34 for allowing passage of pool water and debris into the filter zone 36 which is defined by the filter body front, back, sides, front and top. An opening 38 is also provided in the filter body back 24 for allowing entry of debris and pool water into the filter zone 36.

As particularly contemplated by the present invention, a first debris collecting means associated with the opening 34 in the front 22 of the filter body 12 is provided by a first lower resilient lip 40 and a first upper lip 42. The lower lip 40 is preferably made from a resilient material such as rubber or other suitable flexible elastomer. The first lower lip 40 extends entirely across the filter body front 22 and is mounted on mounting flange 44 of bottom 30. The lower lip 40 may be mounted on the mounting flange 44 in any convenient manner including the use of screws, adhesives or press fitting. The resiliency of the first lower lip is important since it is desirable that the lip be resilient enough to conform to irregularities in the pool surface 48 to provide scraping action over the entire pool surface 48 as the apparatus 10 is moved along the surface 48. The first upper lip 42 is mounted on the filter body front 22 by way of upper mounting flange 46 and like the first lower lip 40 may be mounted in any conventional manner. Whether or not the first upper lip 42 is resilient is not particularly critical; however, it is preferred that the first upper lip 42 be of a non-resilient material, such as hard plastic, rubber or metal so that it retains its shape during forward and backward movement of the pool cleaning apparatus 10.

In addition to the first debris collector means 14, second debris collector means 16 are provided by a second resilient lower lip 50 which is attached to the filter body bottom 30 at mounting flange 52 and a second upper non-resilient lip 54. The upper lip 54 is attached to the filter body back 24 by way of upper mounting flange 56. The second debris collector 16 is identical to the first debris collector 14 and mounted to the filter body 12 in the same manner with the only difference being the first debris collector is associated with opening 34 in the filter body front 22, while the second debris collector 16 is associated with the opening 38 in the filter body back 24.

In order to provide movement of the pool cleaning apparatus 10 on the pool surface 48, wheel means as particularly contemplated by the present invention is provided by the wheel assembly 20. The wheel assembly includes wheels 58 and 60 and axle 62 for slidably mounting wheels 58 and 60 within strut 64. Although the particular composition of the wheels 58 and 60 is not particularly critical, it is preferred that the wheels be made of a somewhat resilient rubber or plastic material which will not mar the pool surface 48 while providing adequate gripping to prevent unwanted sliding of the cleaning apparatus 10. The strut 64 includes a lengthwise slot 66 which allows slidable movement of axle 62 between a rearward position as shown in FIG. 2 and a forward position as shown in FIG. 3.

Figure 2:
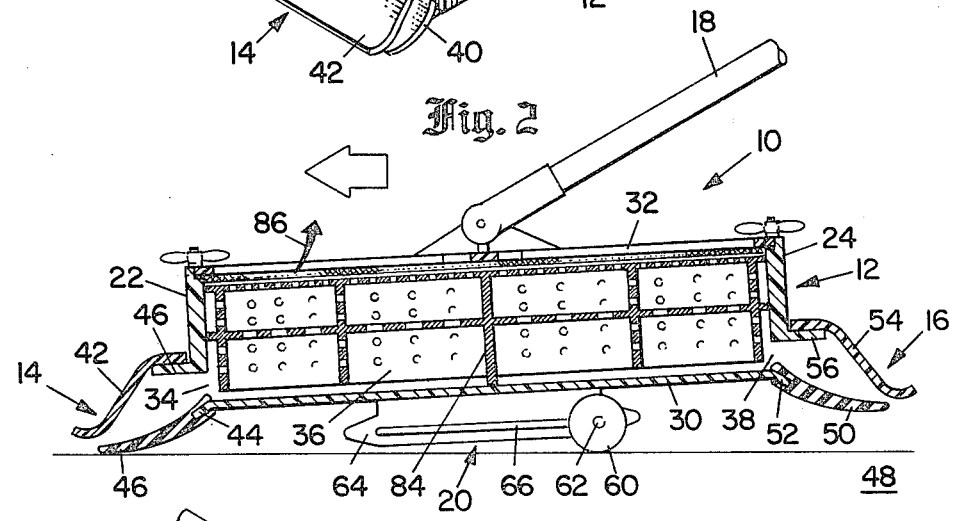
FIG. 2 is a side cross-sectional view of FIG. 1 taken in the II—II plane showing operation of the preferred embodiment during forward movement.
Figure 3:
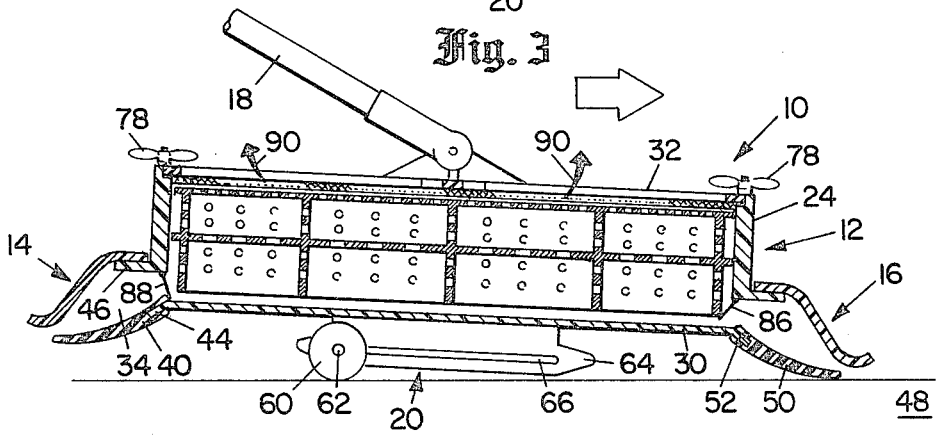
FIG. 3 is also a cross-sectional view of FIG. 1 taken in the II—II plane.
Figure 4:
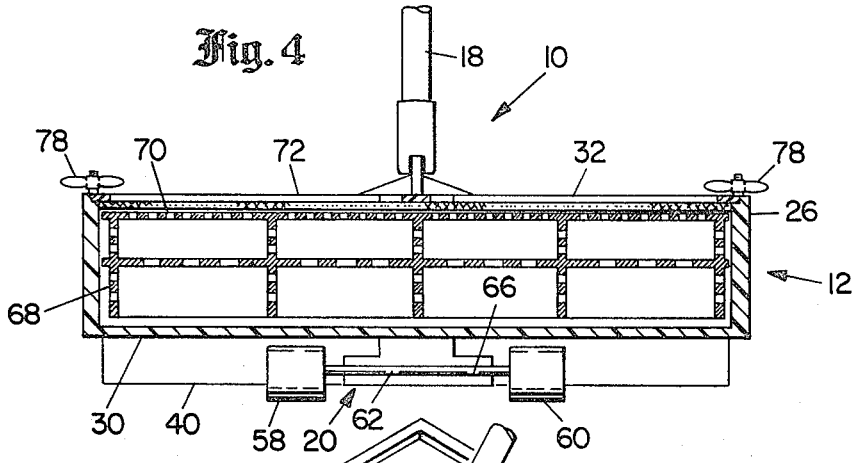
FIG. 4 is a cross-sectional view of FIG. 1 taken in the IV—IV plane.

FIGS. 2 and 3 show the positioning of wheels 58 and 60 during forward cleaning movement and backward cleaning movement respectively. As shown in FIG. 2, during forward cleaning movement, the wheels 58 and 60 are fully to the rear in strut slot 66. In this position, the second debris collector 16 is raised above pool surface 48 while the first debris collector 14 is lowered into contact with the pool surface 48. On the other hand, during backward movement of the filter body 12 as shown in FIG. 3, the wheels 58 and 60 are moved to their full forward position within strut slot 66 resulting in the lifting of first debris collector 14 away from the pool surface 48, while the second debris collector 16 is lowered into cleaning contact with the pool surface 48. The handle 18 is mounted centrally over the filter body 12 so that pushing forces exerted on handle 18 result not only in forward or backward movement of the filter body 12 but also include a certain amount of downward pressure to insure adequate scraping and cleaning of dirt and debris from the pool surface 48 by the lower resilient lips 40 and 50.

Figure 5:
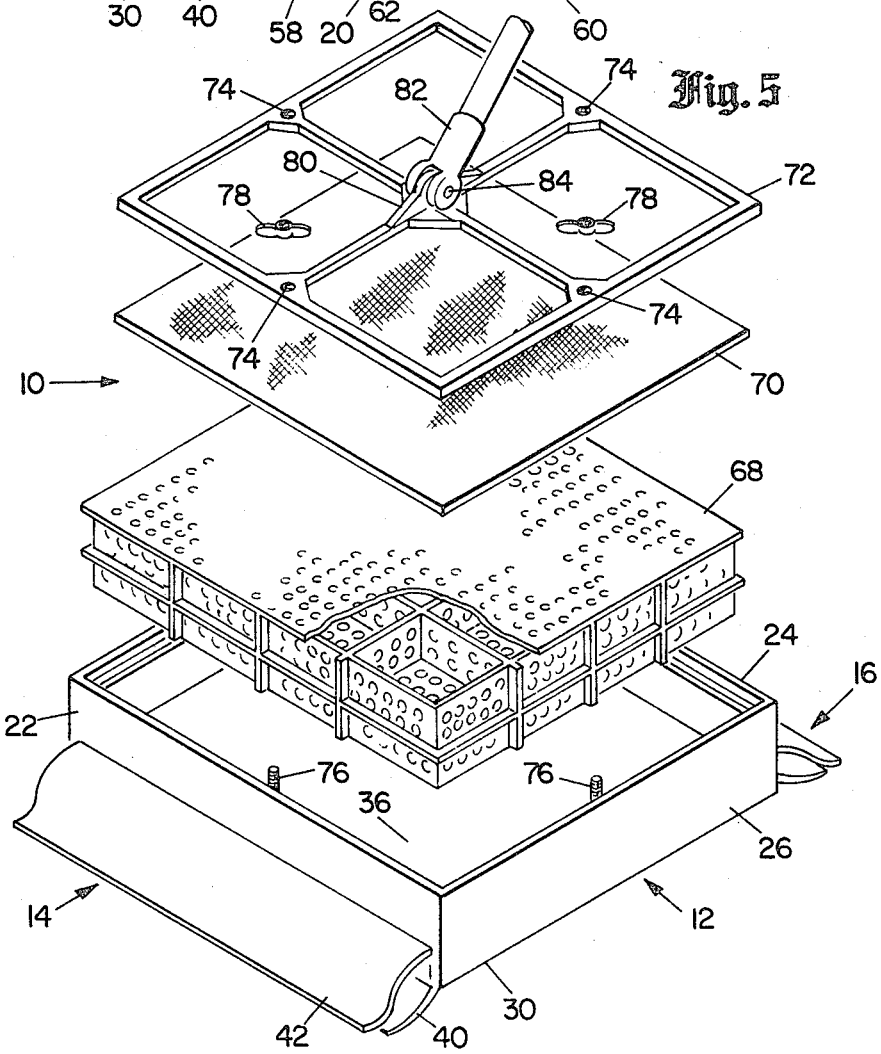
FIG. 5 is an exploded view of FIG. 1 showing removal of the two preferred filtering elements.

Filtering means located within the filtering zone 36 for filtering dirt and debris from pool water as it passes through openings 34 and 38 and out of the filter body through the open top 32 is provided by coarse filter means such as foraminous partitioned insert 68 (as best shown in FIG. 5) and fine filter means such as filter pad element 70. The foraminous partitioned insert 68 is preferably made from a suitable hard plastic or wire mesh material. The actual size of the holes passing through the insert 68 are not especially critical. However, it is desirable to provide holes in the insert 68 of sufficient size to allow relatively free passage of pool water therethrough with only larger debris and dirt particles being retained therein. Alternatively, a highly porous wire or plastic mesh material could also be substituted for the foraminous partitioned insert 68. The holes within the partitioned insert 68 do not have to be uniformly sized and may be varied within a particular insert, or a number of different inserts may be used having various uniform hole sizes. In this way, inserts may be changed to accommodate different dirt and debris cleaning situations.

Since the foraminous partitioned insert 68 is not designed to filter and remove minute dirt and debris particles, the filter pad element 70 is utilized for filtering out these minute particles which are not trapped within the foraminous partitioned insert 68. The filter pad element 70 may be constructed of any suitable fine mesh material including fiberglass, metal, plastic and other suitable mesh materials. The particular size of the mesh openings within filter pad element 70 is not particularly critical; however, it is preferred that the openings be sufficiently small to trap the majority of dirt and debris which is not retained in the foraminous partitioned insert 68 while still allowing adequate flow of pool water therethrough.

In the preferred embodiment, the foraminous partitioned insert 68 and filter pad element 70 are both easily removed from the filter zone 36 for cleaning and replacement if necessary. Filter-retaining means for holding the partitioned insert 68 and filter pad element 70 within the filter body 12 is provided by frame 72. Although the frame (as best shown in FIG. 5) is a square configuration having perpendicular cross bars, this configuration is not critical and any suitable frame configuration may be utilized so long as it does not block flow of pool water and provides sufficient strength for mounting the handle 18 thereto.

Referring to FIG. 5, the frame 72 includes mounting holes 74 which are mountable on threaded mounting studs 76. Wing nuts 78 or other suitable easily removed nuts are provided for securing the retaining frame 72 to the filter body 12 by way of mounting studs 76. The retaining frame 72 is also provided with a mounting bracket 80 which is sufficiently reinforced to allow mounting of handle 18 thereon. The handle 18 includes handle bracket 82 which when mounted to mounting bracket 80 with mounting pin 84 provides a rotatable mounting of handle 18 to the filter body 12 so that the handle may be rotated to various positions between those shown in FIGS. 2 and 3 for operation of the pool cleaning apparatus 10.

As shown in FIG. 2, during forward operation of the pool cleaning apparatus 10, means are provided for preventing passage of pool water out of the filter body 12 through the opening 38 in the filter body back 24 by weir 84 which is centrally located within the filter zone 36. By placing weir 84 integrally within the foraminous partitioned inserts 68, pool water is forced upward and out of the filter body top as shown by arrow 86 while being prevented from passing out of the filter body 12 through opening 38. This feature of the present invention is important in that it prevents pool water from flowing out through opening 38 and onto pool surface 48 to create disturbing turbulence which stirs up remaining dirt and debris adjacent the pool cleaning apparatus 10 on pool surface 48.

As shown in FIG. 3, an alternative means for preventing the undesirable flow of pool water out of the openings in the filter body 12 is shown. This preventing means includes one way valve 88. During backward movement of the pool cleaning apparatus 10, one way valve 86 is forced open thereby allowing pool water, dirt and debris to enter the filtering zone 36 while at the same time, one way valve 88 is forced closed thereby preventing flow of pool water and dirt or debris out through opening 34. Utilizing the one way valves, allows for flow of pool water out of the filter body top 32 over the entire surface as shown by arrows 90.

Having thus described exemplary embodiments of the present invention, it should be noted by those skilled in the art that the within disclosures are exemplary only and that various other alternatives, adaptations and modifications may be made within the scope of the present invention. Thus, by way of example and not of limitation, if desired the resilient lower lips could include brushes or other means for scrubbing the surface to enhance surface cleaning. Accordingly, the present invention is not limited to the specific embodiments as illustrated herein.

What is claimed is:

1. A simplified, self-contained, pool cleaning apparatus adapted for the cleaning of pool surfaces comprising:

a filter body having a bottom, an open top, two sides, a front and a back defining a filtering zone;

first means associated with an opening in the front of said filter body for collecting and introducing pool water and debris into said filter zone during forward movement of said filter body, said first debris collecting means including a first lower resilient lip across said filter body front for contacting and scraping debris from said pool surfaces, said first lower lip being sufficiently stiff to support said apparatus during forward movement of said apparatus;

second means associated with an opening in the back of said filter body for collecting and introducing pool water and debris into said filter zone during backward movement of said filter body, said second debris collecting means including a second lower resilient lip across said filter body back for contacting and scraping debris from said pool surfaces, said second lower lip being sufficiently stiff to support said apparatus during backward movement of said apparatus;

filter means located within said filtering zone for filtering said debris from pool water as it passes from said debris collecting means through said filter zone and out of said filter body;

handle means mounted to said filter body for providing manual movement of said filter body in said forward and backward directions, said handle means being mounted at a fixed location on the top of said filter body substantially equidistant from said filter body back and front; and wheel means for facilitating forward and backward movement of said filter body on said pool surfaces for collection of debris in said first and second debris collecting means respectively said wheel means being mounted movably to the bottom of said filter body for movement forward and rearward of the fixed handle means mounting location whereby pressure may be exerted through said handle means to said lower resilient lips during forward and rearward movement of said filter body to provide scraping of debris from said pool surfaces.

2. A pool cleaning apparatus according to claim 1 further including means for preventing passage of pool water out of said filter body through the opening in said filter body back during forward movement of said filter body and for preventing passage of pool water out of said filter body through the opening in said filter body front during backward movement of said filter body.

3. A pool cleaning apparatus according to claim 2 wherein said water passage preventing means includes a centrally located weir to divide said filtering zone into a front filter chamber and a back filter chamber.

4. A pool cleaning apparatus according to claim 2 wherein said water passage preventing means includes one way valves associated with the openings in said filter body front and back which allow pool water and debris flow into said filter zone, but not out of said filter zone.

5. A pool cleaning apparatus according to claim 1 wherein said filter means includes coarse filter means for filtering of relatively large debris from the pool water and fine filter means for filtering relatively small debris from the pool water.

6. A pool cleaning apparatus according to claim 5 whereby said coarse filter means includes a foraminous partitioned insert.

7. A pool cleaning apparatus according to claim 6 wherein said fine filter means includes a filter pad element located on top of said foraminous partitioned insert.

8. A pool cleaning apparatus according to claim 7 wherein said filter pad element and foraminous partitioned insert are removable from said filter body through said open top and means are provided for releasably retaining said filter pad element and foraminous insert within said filter body.

9. A pool cleaning apparatus according to claim 8 wherein said filter retaining means includes a frame releasably mounted on the top of said filter body.

10. A pool cleaning apparatus according to claim 9 wherein said handle means is mounted on said frame.

11. A pool cleaning apparatus as defined in claim 1 wherein said apparatus includes means for rendering said first collecting means operative and for closing said second collecting means when said filter body is moved in one direction, and for rendering said second collecting means operative and for closing said first collecting means when said filter body is moved in the other direction.

12. A pool cleaning apparatus as defined in claim 1 wherein said filter means has one side exposed to said filter zone within said filter body and the other side substantially open, whereby pool water entering through said collecting means is directly returned to the pool following local filtering of debris.

* * * * *